US005194217A

United States Patent [19]

St. Louis et al.

[11] Patent Number: 5,194,217

[45] Date of Patent: Mar. 16, 1993

[54] ARTICULATED SLUDGE LANCE WITH A MOVABLE EXTENSION NOZZLE

[75] Inventors: Daniel M. St. Louis, Plymouth, Mich.; William G. Schneider, Branchton, Canada

[73] Assignee: The Babcock & Wilcox Company, New Orleans, La.

[21] Appl. No.: 819,249

[22] Filed: Jan. 10, 1992

[51] Int. Cl.[5] ..... G21F 9/00

[52] U.S. Cl. ..... 376/316; 122/382; 134/167 R; 134/180; 165/95; 239/588

[58] Field of Search ..... 376/316, 310, 309, 308; 122/379, 382, 383, 390, 392, 405; 165/95; 134/167 R, 167 C, 172, 180; 239/288.3, 288.5, 532, 587.1, 587.5, 588

[56] References Cited

U.S. PATENT DOCUMENTS

| | | | |
|---|---|---|---|
| 4,079,701 | 3/1978 | Hickman et al. | 376/310 |
| 4,276,856 | 7/1981 | Dent et al. | 122/382 |
| 4,407,236 | 10/1983 | Schukei et al. | 122/382 |
| 4,424,769 | 1/1984 | Charamathieu et al. | 122/392 |
| 4,572,284 | 2/1986 | Katscher et al. | 122/392 |
| 4,826,087 | 5/1989 | Chinery | 239/588 |
| 4,827,953 | 5/1989 | Lee | 122/392 |
| 4,980,120 | 12/1990 | Bowman et al. | 376/316 |
| 5,069,172 | 12/1991 | Shirey et al. | 122/382 |

*Primary Examiner*—Daniel D. Wasil

*Attorney, Agent, or Firm*—Robert J. Edwards; Vytas R. Matas; Daniel S. Kalka

[57] ABSTRACT

An improved articulated sludge lance with a retractable movable extension nozzle for cleaning a steam generator. The extension nozzle includes a flexible conduit adapted to be moved with a wire cable to place the nozzle in close proximity to a support plate for effectively cleaning the broached holes therein. A bumper member fastened to the flexible conduit provides a side-to-side motion from impact with the tubes when the lance is moved therethrough.

9 Claims, 5 Drawing Sheets

ARTICULATED SLUDGE LANCE WITH A MOVABLE EXTENSION NOZZLE

BACKGROUND OF THE INVENTION

1. Field of the Invention

The present invention relates generally to equipment for cleaning steam generators, and particularly to an improved articulated fluid lance having an extension nozzle that is movable for bringing the fluid jet into close proximity with the broached holes in the support plates for a nuclear steam generator for more efficiently cleaning sludge from steam generators.

2. Description of the Related Art

In nuclear power stations, steam generators, such as recirculating steam generators and once-through steam generators, are used for heat exchange purposes in the generation of steam to drive the turbines. Primary fluid which is heated by the core of the nuclear reactor passes through a bundle of tubes in the steam generator. The secondary fluid, generally water, which is fed into the space surrounding the tubes receives heat from the tubes and is converted into steam for driving the turbines. After cooling and condensation has occurred, the secondary fluid is directed back into the space around the tubes to provide a continuous steam generation cycle. Due to the constant high temperature and severe operating conditions, sludge accumulates on the lower portions of the tubes, support plates, and on the tube sheet which supports same. The sludge which is mainly comprised of an iron oxide, such as magnetite, reduces the heat transfer efficiency of the tubes and can cause corrosion. Thus, the tubes must be cleaned periodically to remove the sludge and various types of apparatus and method are available to accomplish this task.

U.S. Pat. No. 4,980,120 which is assigned to the Assignee of the present invention, and hereby incorporated by reference, discloses an articulated sludge lance.

In addition, U.S. Pat. No. 4,980,120 in the background art section describes various other techniques found in U.S. Pat. Nos. 4,566,406; 4,079,701 and 4,700,662.

In addition to those references, U.S. Pat. No. 4,407,236 to Schukei, et al discloses a thin strip of spring steel which enters a tube lane for sludge lance cleaning for nuclear steam generators. The forward ends of the capillary tubes are directed downward for the jetting of fluid under high pressure.

U.S. Pat. No. 4,827,953 to Lee is directed to a flexible lance for steam generator secondary side sludge removal. This patent discloses a flexible lance having a plurality of hollow, flexible tubes extending lengthwise along the flexible member. There are a plurality of nozzles at an end of the flexible members with the flexible member being configured to go into the difficult to access geometry of the steam generator.

When using the articulated sludge lance, penetration into the steam generator must be at least seven inches below the individual support plates due to stress considerations. This means jetting water from seven inches away while moving the articulated sludge lance parallel to the support plate. It has been found that the effectiveness of the cleaning diminishes considerably with distance from the support plate. Of particular concern is the deposits blocking broached holes.

Because of the foregoing, it has become desirable to develop an improved articulated sludge lance which jets the fluid at close proximity to the broached support plate taking into consideration the stress factors.

SUMMARY OF THE INVENTION

The present invention solves the aforementioned problems associated with the prior art as well as others by providing a movable extension nozzle on an articulated sludge lance. The extension nozzle can be moved elastically with a tension cable to a predetermined curvature and height so as to place the nozzle in close proximity to a support plate. The improved articulated sludge lance of the present invention includes a bumper member attached to the flexible conduit of the nozzle to interact with the tubes in the tube lane as the lance moves therethrough creating a side-to-side motion so that the path of the fluid jet intersects as many of the broached holes as possible.

In an alternate embodiment, the improved articulated sludge lance includes actuating means to allow the extension nozzle to extend from a retracted position in the fluid distribution member after it is inserted in place in a tube lane. This facilitates the movement of the improved articulated sludge lance into a specific tube lane in a steam generator for cleaning thereof.

Accordingly, an object of the present invention is to provide an improved articulated sludge lance with a movable extension nozzle.

Another object of the present invention is to provide an improved articulated sludge lance with an extension nozzle that can be moved to a predetermined curvature and height so as to place the nozzle in close proximity to a support plate for more efficient cleaning.

A further object of the present invention is to provide an improved articulated sludge lance with a bumper member that causes the water jet from the lance to intersect as many broached holes as possible in a support plate by means of a side-to-side motion imparted to the extension nozzle.

Yet a further object of the present invention is to provide a retractable, movable extension nozzle for an articulated sludge lance.

Still, a further object of the present invention is to provide a device which is simple in design, rugged in construction, and economical to manufacture.

The various features of novelty characterizing the invention are pointed out with particularity in the claims annexed to and forming a part of this disclosure. For a better understanding of the invention, and the operating advantages attained by its uses, reference is made to the accompanying drawings and descriptive matter in which a preferred embodiment of the invention is illustrated.

DESCRIPTION OF THE PREFERRED EMBODIMENT

Figure 1:
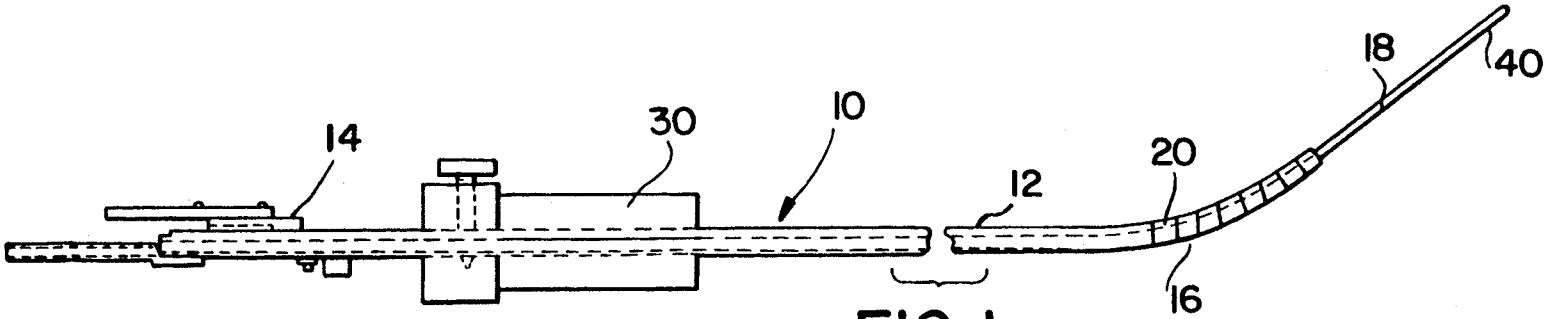
FIG. 1 PRIOR ART
FIG. 1 is a front elevational view of an articulated sludge lance disclosed in U.S. Pat. No. 4,980,120.

Referring to the figures generally, wherein like numerals designate the same element throughout the several drawings, and first to FIG. 1 in particular, there is shown the articulated sludge lance (10) as disclosed in U.S. Pat. No. 4,980,120, hereby incorporated into this application by reference. The sludge lance (10) is comprised of a manipulator member (12), a cam assembly (14) attached to one end of the manipulator member (12), a spring backing plate (16) attached to the underside of the manipulator member (12) adjacent to the opposite end thereof, and a water distribution member (18) positioned so that a portion thereof is interposed between the bottom surface of the manipulator member (12) and the top surface of the spring backing plate (16).

The manipulator member (12) is formed from a high impact strength plastic, is elongated and typically has a substantially rectangular cross-section. A plurality of radius blocks (20) each having a substantially rectangular cross-section of approximately the same size as the manipulating member (12) is attached to the opposite end of the manipulator (12) so as to be aligned therewith. Attachment is effected by means of the spring backing plate (16) which is attached to the bottom of the manipulator member (12) and to the bottom of each of the radius blocks (20) by fasteners (22). The radius blocks (20) are positioned in an abutting relationship to one another and to the end of the manipulator member (12).

Figure 2:
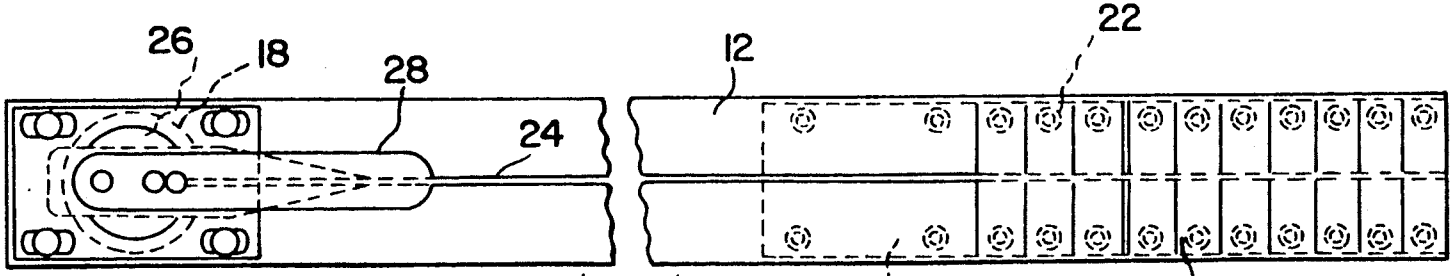
FIG. 2 PRIOR ART
FIG. 2 is a top plan view of the articulated sludge lance shown in FIG. 1.

As shown in FIG. 2, a wire cable (24) traverses through the length of the manipulator member (12) and through each of the radius blocks (20). One end of the cable (24) is connected to the outermost radius block (20) and the other end of the cable (24) is connected to a pin (26) (shown in phantom) within the cam assembly (14). A cam lever (28) is attached to the cam assembly (14) permitting rotation thereof. Rotation of the cam lever (28) in a clockwise direction causes the wire cable (24) to move to the left causing the radius blocks be drawn into an arc with respect to the manipulator member (12) as illustrated in FIG. 1. Subsequent rotation of the cam lever (28) back to its original position causes the wire cable (24) to move to the right resulting in the radius blocks (20) returning to their original position so as to be in the same plane as manipulator member (12). The spring backing plate (16) urges the radius blocks (20) to return to their original position.

The water distribution member (18) is elongated and has a substantially rectangular cross-section which is similar to, but smaller, than the rectangular cross-section of the manipulator member (12) and the radius blocks (20). The water distribution member (18) is received within a recess provided within the bottom of the manipulator member (12). The water distribution member (18) is similarly received within a recess provided within the bottom of each radius block (20) so as to be interposed between the spring backing plate (16) and the radius blocks (20). The length of the water distribution member (18) is greater than the combined length of the manipulator member (12) and the radius blocks (20) attached thereto causing the outer end of the water distribution member (18) to be exposed.

In the present invention, modifications have been made to the water distribution member (18) with particular emphasis on the water tubes (36).

Figure 3:
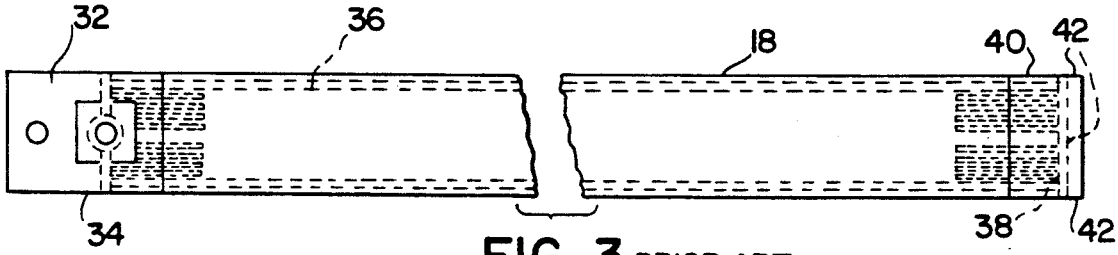
FIG. 3 PRIOR ART
FIG. 3 is a top plan view of the fluid distribution member utilized by the articulated sludge lance.
Figure 5:
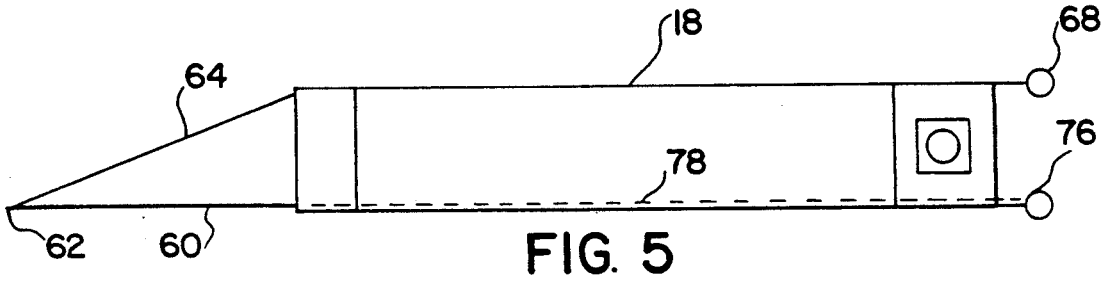
FIG. 5 is an elevational sectional view of the fluid distribution member illustrating the extension nozzle in accordance with the present invention.

Referring now to FIG. 5, there is shown a flexible fluid conduit (60) extending from the water distribution member (18). Referring back to FIG. 3, the articulated sludge lance as described in U.S. Pat. No. 4,980,120 provides for water tubes (36) terminating in a transverse passageway (38) located in a split manifold (40) at the outer end of the water distribution member (18). Now referring to FIG. 5, the flexible fluid conduit (60) is fluidly coupled to the transverse passageway (38) and receives fluid therefrom. Preferably, the flexible fluid conduit (60) is provided with at least one nozzle (62) for spraying a fluid in one or more directions from the outermost end of the flexible fluid conduit (60). To minimize wear, the nozzle (62) may be provided with a sapphire jewel or a ceramic insert. The flexible fluid conduit (60) is formed from a high impact strength plastic which is resilient in nature.

Figure 6:
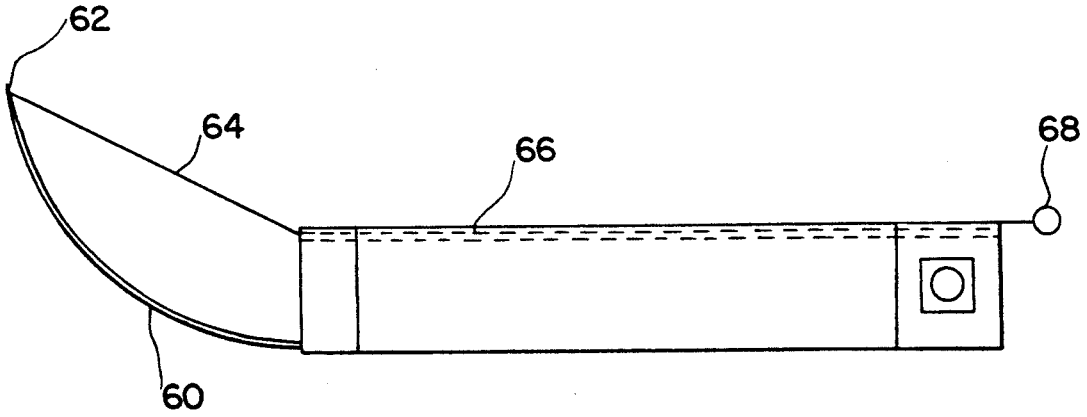
FIG. 6 is a view similar to FIG. 5 showing the tensioned cable moving the extension nozzle to a predetermined curvature and height.

Attached to the outermost end of the flexible fluid conduit (60) is a wire cable (64) which runs lengthwise through a cable tube (66) through the water distribution member (18) traversing through the length of the manipulator member (12) to an actuating means (68) such as a knob or a cam assembly similar to cam assembly (14) which when pulled tensions the wire cable (64) from a first position substantially parallel to the fluid distribution member (18) as shown in FIG. 5 to a second position as shown in FIG. 6. In the second position, the flexible fluid conduit (60) is elastically curved upward to a predetermined curvature and height so as to place the nozzle (62) in close proximity to a support plate. Preferably, nozzle (62) would be within about ½ inch away from the support plate while the water distribution member (18) would be at least seven inches below. This will greatly improve the effectiveness of the articulated sludge lance in cleaning these hard to reach areas. FIG. 6 illustrates how the flexible fluid conduit (60) forms an arc which is planar to the fluid distribution member (18) and directs the fluid in a preset direction. In the case at hand, the direction is upwardly, however, any direction can be achieved and with a nozzle having more than one orifice in several directions a substantially large area may be cleaned all at one time. The flexible fluid conduit (60) is designed to be employed in conjunction with the outlet orifices (42) of the water distribution member (18) to efficiently clean the steam generator.

In a similar fashion, the tension cable (64) may be tensioned to direct the nozzle (62) downwards. While one wire cable (64) is depicted, it is envisionable that several cables may be employed in the manner previously described to direct nozzle (62) in a desired direction.

Figure 4:
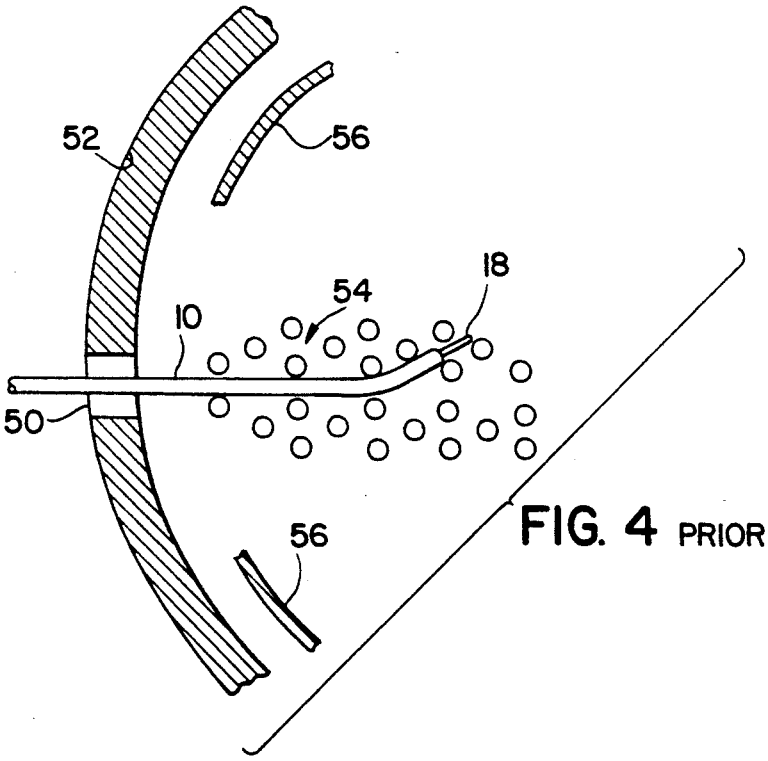
FIG. 4 PRIOR ART
FIG. 4 is a top plan view of the articulated sludge lance employed in a steam generator.

As described in U.S. Pat. No. 4,980,120, the sludge lance (10) is inserted through a hand hole (50) provided in a steam generator shell (52) and into a lane or space between tubes in a tube bundle (54) as shown in FIG. 4. The rotation of cam lever (28) adjusts an angular deflection of the radius blocks (20) to permit the sludge lance

(10) to enter between the tubes within the tube bundle (54). At this point, the wire cable (64) is pulled tight to cause the flexible fluid conduit (60) to curve as illustrated in FIG. 6 to clean a support plate. As the sludge lance (10) is moved through the tube bundle (54) a fluid flow from the outlet orifices (42) in the water distribution member (18) as well as nozzle (62) in the flexible fluid conduit loosens and removes sludge from the tubes as well as the support plate with the sludge then being removed from the generator by a conventional suction system.

Figure 7:
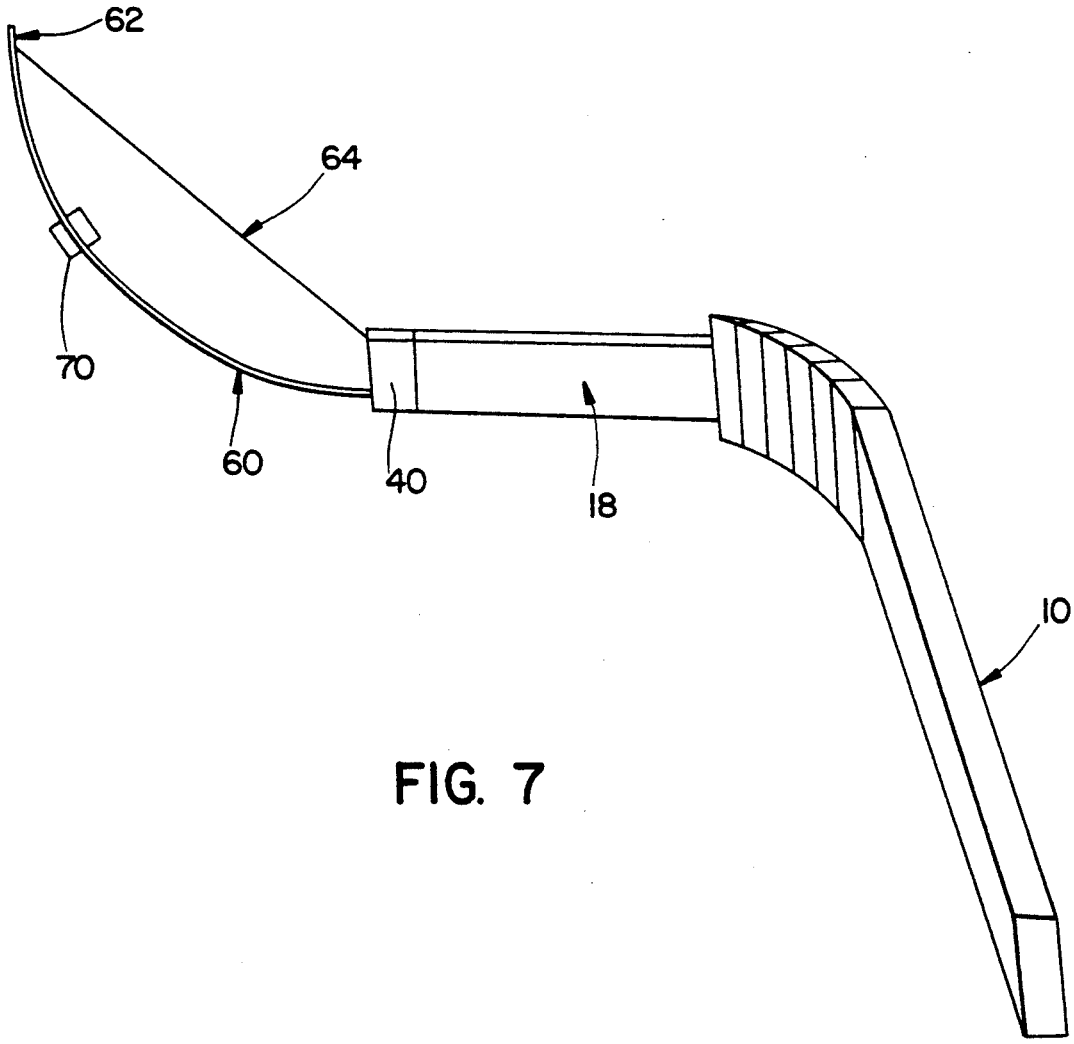
FIG. 7 is a perspective view of the present invention illustrating the movable extension nozzle with the bumper member.

Next, referring to FIG. 7, the present invention advantageously provides a bumper member (70) which through a bumping interaction with the tubes in a tube bundle (54) causes the nozzle (62) to move in a side-to-side fashion as it travels through the lane. In this manner, the water or fluid jet intersects as many of the broached holes in the lane as possible as illustrated in FIG. 8.

Figure 8:
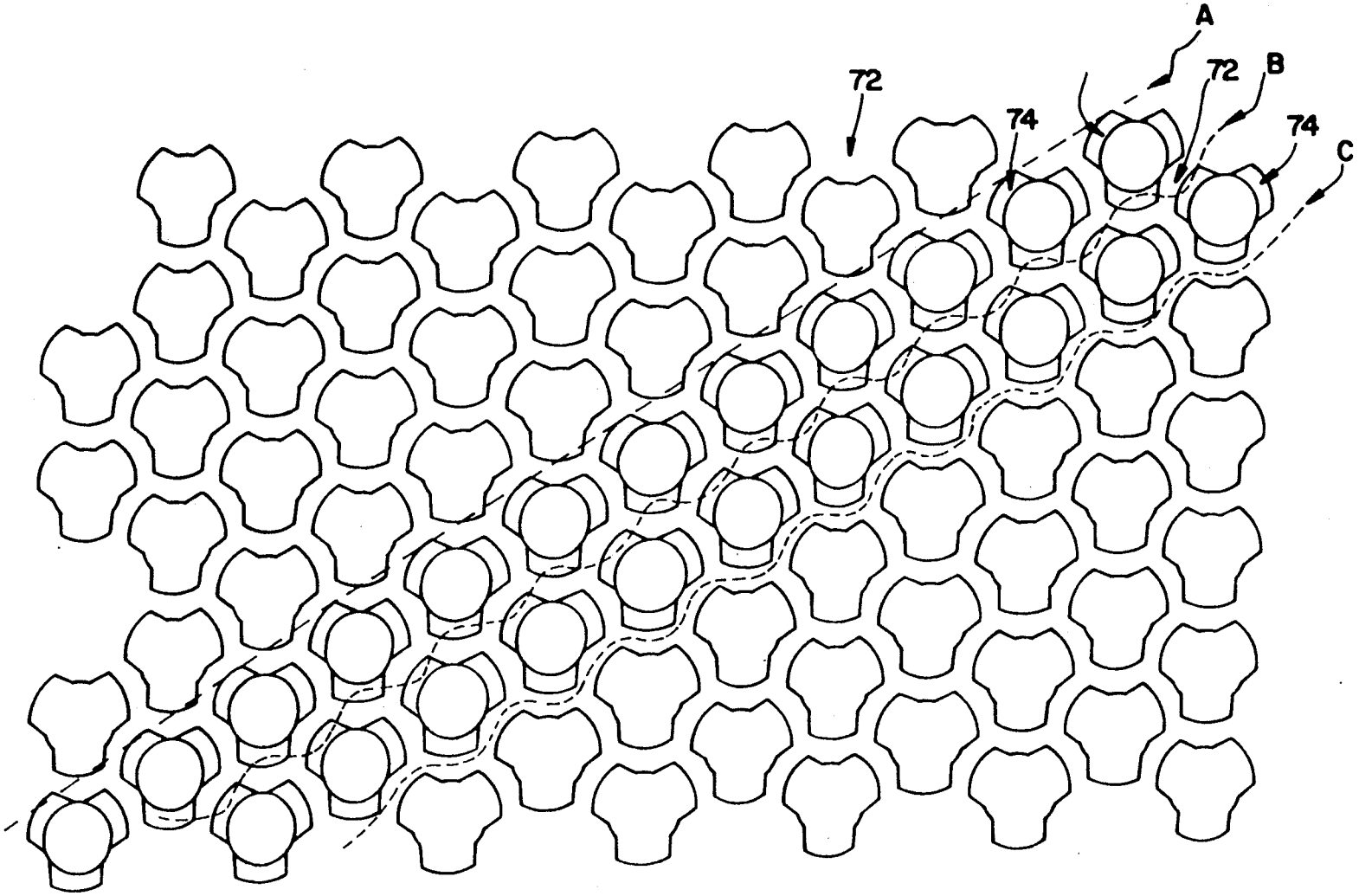
FIG. 8 is a top sectional view of a broached tube support plate illustrating some of the tubes in section, and depicting the motion of the articulated sludge lance therethrough via several paths labeled A, B, C, in dashed line.

There are three potential paths (A, B, C) shown in FIG. 8 in phantom line. The first path, A, describes the way the current lance would sweep across the support plate. As illustrated, the water jet depicted by the phantom line labeled A spends much of the time on the support plate (72), rather than removing the deposits blocking the broached holes (74). The addition of the bumper member (70) which may also be formed from a high impact strength plastic or polytetra fluoroethlene impacts the tubes in the steam generator thereby causing the nozzle (62) to travel with a side-to-side motion as the lance moves through the lane. This path is shown in phantom line labeled B in FIG. 8. The path labeled C illustrates what happens when the side-to-side motion caused by the bumper member (70) is not synchronized properly. It can be self defeating in that the water jet impinges only on the support plate while not cleaning the broached holes (74). This dilemma is easily overcome by adjusting the bumper member (70) along the length of the pressure fluid conduit (60) to achieve path B either by visual inspection or by calibration on a model or actual example.

Referring back to FIGS. 5 and 6, while a wire cable (64) with an actuating means (68) is described and shown, it should be understood that there are other positioning means which may be employed to move the flexible fluid conduit (60) to form an arc such as a rod. In addition, even though the flexible fluid conduit (60) is shown situated outside of the water distribution member (18), a further feature of the present invention allows the flexible fluid conduit (60) to be retracted so that substantially all of the flexible fluid conduit (60) is initially located in an opening or a passageway in the fluid distribution member (18) as shown by dashed lines in FIG. 5. This orientation facilitates the movement of the sludge lance (10) through the tube bundle to some preset starting point. When cleaning is to be commenced, a second actuating means such as a knob (76) or a cam assembly moves the flexible fluid conduit (60) out of the fluid distribution member passageway (78) so that an aperture (not shown) in the fluid distribution member (60) aligns with the transverse passageway (38) to receive fluid therefrom. Suitable rubber sealing means such as O-rings or gaskets are employed to prevent leaks and maintain a proper pressure tight seal.

While a specific embodiment of the invention has been shown and described in detail to illustrate the application and principles of the invention, certain modifications and improvements will occur to those skilled in the art upon reading the foregoing description. It is thus understood that all such modifications and improvements have been deleted herein for the sake of conciseness and readability but are properly within the scope of the following claims.

We claim:

1. An improved articulated sludge lance having a manipulator member, a plurality of block members attached to one end of the manipulator member and being actuatable to form an arc, and a fluid distribution member situated within the manipulator member for passing fluid therethrough, the improvement comprising:

a flexible conduit constructed to extend out from an outer most end of the fluid distribution member;

means for translating said flexible conduit from a first position where said flexible conduit is substantially situated inside the fluid distribution member for facilitating movement through a tube lane in a steam generator to a second position wherein said flexible conduit extends out of the fluid distribution member for cleaning; and means for positioning said flexible conduit in a preset direction for directing the fluid in close proximity to a support plate for cleaning the steam generator.

2. An improved articulated sludge lance as recited in claim 1, wherein said positioning means causes said flexible conduit to form an arc which is planar to the fluid distribution member.

3. An improved articulated sludge lance as recited in claim 1, further comprising a bumper member attached to said flexible conduit for interacting with tubes in a tube lane when the sludge lance is moved therethrough to effect a side-to-side motion of said flexible conduit.

4. An improved articulated sludge lance as recited in claim 1, wherein said positioning means comprises a cable connected to an outermost end of said flexible conduit, said cable passing through a passageway in the fluid distribution member, and being adapted to move said flexible conduit in a predetermined direction so as to place said flexible conduit into close proximity with a support plate.

5. An improved articulated sludge lance as recited in claim 4, further comprising a cam assembly attached to said cable and located on the manipulator member, said cam assembly including lever means for tensioning said cable to move said flexible conduit.

6. An improved articulated sludge lance as recited in claim 1, further comprising a nozzle positioned on an outer end of said flexible conduit.

7. An improved articulated sludge lance as recited in claim 6, further comprising a bumper member attached to said flexible conduit for interacting with tubes in a tube lane when the sludge lance is moved therethrough to effect a side-to-side motion of said flexible conduit.

8. An improved articulated sludge lance as recited in claim 6, wherein said positioning means comprises a cable connected to an outermost end of said flexible conduit, said cable passing through a passageway in the fluid distribution member, and being adapted to move said flexible conduit in a predetermined direction so as to place said flexible conduit into close proximity with a support plate.

9. An improved articulated sludge lance as recited in claim 6, wherein said nozzle comprises a plurality of orifices for directing fluid in several directions.

* * * * *